US007760050B2

(12) United States Patent
Atokawa et al.

(10) Patent No.: US 7,760,050 B2
(45) Date of Patent: Jul. 20, 2010

(54) DIELECTRIC FILTER HAVING TAPERED INPUT/OUTPUT ELECTRODES

(75) Inventors: Masayuki Atokawa, Ishikawa-gun (JP); Takahiro Okada, Moriyama (JP); Takayoshi Yui, Nagaokakyo (JP)

(73) Assignee: Murata Manufacturing Co., Ltd., Nagaokakyo-shi, Kyoto-fu (JP)

( * ) Notice: Subject to any disclaimer, the term of this patent is extended or adjusted under 35 U.S.C. 154(b) by 0 days.

(21) Appl. No.: 12/402,908

(22) Filed: Mar. 12, 2009

(65) Prior Publication Data

US 2009/0167463 A1 Jul. 2, 2009

Related U.S. Application Data

(63) Continuation of application No. PCT/JP2007/073691, filed on Dec. 7, 2007.

(30) Foreign Application Priority Data

Feb. 9, 2007 (JP) ..... 2007-030143

(51) Int. Cl.
*H01P 1/205* (2006.01)

(52) U.S. Cl. ..... 333/202; 333/206

(58) Field of Classification Search ..... 333/202, 333/206, 134, 222

See application file for complete search history.

(56) References Cited

U.S. PATENT DOCUMENTS 6,278,343 B1 * 8/2001 Okada et al. ..... 333/206
6,621,383 B2 * 9/2003 Nakamura et al. ..... 333/206
2002/0075095 A1 * 6/2002 Hiroshima et al. ..... 333/134

FOREIGN PATENT DOCUMENTS

| | | |
|---|---|---|
| EP | 0 793 696 | 11/1996 |
| JP | 5-121905 | 5/1993 |
| JP | 7-162212 | 6/1995 |
| JP | 8-316703 | 11/1996 |
| WO | WO-2005/067093 | 7/2005 |

OTHER PUBLICATIONS

PCT/JP2007/073691 International Search Report dated Jan. 22, 2008.

PCT/JP2007/073691Written Opinion dated Jan. 22, 2008.

* cited by examiner

*Primary Examiner*—Benny Lee
(74) *Attorney, Agent, or Firm*—Dickstein, Shapiro, LLP.

(57) ABSTRACT

A dielectric filter having inner-conductor holes penetrating through a dielectric block from a first surface to a second surface thereof. An outer conductor and input/output electrodes are formed on an outer surface of the dielectric block. A side of each of the input/output electrodes facing the first surface is substantially in parallel to the first surface, and an intersection of a side facing the second surface and a side facing a sixth surface is tapered. With such a configuration, an attenuation characteristic at an attenuation band is improved by making the attenuation characteristic less likely to receive an influence of a TE mode.

9 Claims, 7 Drawing Sheets

DIELECTRIC FILTER HAVING TAPERED INPUT/OUTPUT ELECTRODES

CROSS REFERENCE TO RELATED APPLICATIONS

The present application is a continuation of International Application No. PCT/JP2007/073691, filed Dec. 7, 2007, which claims priority to Japanese Patent Application No. JP2006-030143, filed Feb. 9, 2007, the entire contents of each of these applications being incorporated herein by reference in their entirety.

FIELD OF THE INVENTION

The present invention relates to a dielectric filter including an outer conductor and input/output electrodes formed on an outer surface of a dielectric block and inner conductors formed inside of the dielectric block.

BACKGROUND OF THE INVENTION

Regarding dielectric filters having an outer conductor and input/output electrodes formed on an outer surface of a dielectric block and inner conductors formed inside of the dielectric block to constitute a plurality of TEM-mode (transverse electromagnetic mode) resonators, Patent Document 1 discloses a dielectric filter that reduces coupling caused by stray capacitance between input/output electrodes and increases external coupling capacitance.

An example of a configuration of a dielectric filter disclosed in Patent Document 1 will be described based on FIG. 1.

In FIG. 1, a dielectric filter 1 has an outer conductor and input/output electrodes 7 and 8 formed on an outer surface of a rectangular dielectric block 2 and inner-conductor holes 3 and 4 formed inside thereof. External coupling capacitance is determined based on a size of an area where the inner conductors formed in the inner-conductor holes and the input/output conductors face each other. Accordingly, to increase the external coupling capacitance, the two input/output electrodes 7 and 8 are formed so as to detour from a mounting surface (upper surface in FIG. 1) against a mounting board to respective lateral faces.

Patent Document 1: Japanese Unexamined Patent Application Publication No. 7-162212

However, in such a dielectric filter having an outer conductor formed on an outer surface of a rectangular dielectric block, transverse electric mode (TE mode) resonance is also generated in a space formed by the dielectric block and the outer conductor formed on the outer surface thereof in addition to TEM-mode resonance, which is originally utilized. This TE mode resonance is determined based on the size and shape of the dielectric block and may exert a harmful effect on a filter characteristic depending on a condition.

FIG. 2 shows a state of an electric field and a magnetic field in a TE101 mode, which is one kind of the TE mode. In FIG. 2, a broken-line loop represents a magnetic field loop, which rotates in a plane parallel to a mounting surface of the dielectric filter 1. An electric field is vertical to the magnetic field. The magnetic field of this TE101 mode is trapped inside of the dielectric block. However, since one surface of the dielectric block is an open circuit surface 21 (FIG. 1), the magnetic loop extends to the outside from the open circuit surface.

A higher-order TE mode is also generated. For example, when a horizontal length of the dielectric block is longer than a vertical length in FIG. 2, a TE201 mode, in which two magnetic field loops lie in the horizontal direction, is generated.

Such a TE mode is, as in the originally utilized TEM mode, also excited and coupled by the input/output electrodes 7 and 8. An amount of the coupling increases as the size of the input/output electrodes 7 and 8 increases.

FIG. 3 shows examples of frequency responses (GHz) of three resonant modes, namely, the TEM mode, the TE101 mode, and the TE201 mode, and of a transmission characteristic S21(dB) between the two input/output electrodes 7 and 8. The transmission characteristic S21(dB) is a coupled result of the responses.

In general, a TE101-mode resonance frequency is higher than a TEM-mode resonance frequency. A TE201-mode resonance frequency appears at a higher position than the TE101-mode resonance frequency. Since the input/output electrodes 7 and 8 cause coupling to an electric field of the TE mode (particularly, the TE101 mode) as well as an electric field of the TEM mode, attenuation of the transmission characteristic of the dielectric filter 1 worsens in an attenuation band compared with a characteristic resulting only from the originally utilized TEM mode.

FIG. 4 shows actually measured examples of the frequency response in GHz. In FIG. 4, a broken line with "TEM" represents an estimated characteristic resulting only from the originally utilized TEM mode, whereas a curve with "TE101" represents an estimated characteristic resulting only from the TE101 mode. A curve with "F" represents a transmission characteristic (S21) in dB between the input/output electrodes 7 and 8 (FIG. 1). The transmission characteristic is hardly influenced by the TE101 mode in a pass band of the dielectric filter, shown by "A". However, attenuation significantly worsens in a neighboring frequency band, shown by B, on a higher side of the pass band. In addition, as shown by "C", attenuation also worsens on a lower side of the pass band by approximately 15-20 dB to be influenced the response of the TE101 mode.

SUMMARY OF THE INVENTION

Since the size of a dielectric block cannot be reduced due to manufacturing constraints, a desired pass band characteristic (center frequency) is determined based on the size and shape of inner-conductor holes. Accordingly, when a dielectric filter used in a high-frequency band is designed, a TEM-mode resonance frequency becomes relatively high while a TE101-mode resonance frequency being kept as it is, as a result of which the frequencies of both modes approach. Accordingly, as a utilized frequency band becomes higher, an attenuation characteristic in an attenuation band tends to worsen notably.

Accordingly, the purpose of the present invention is to provide a dielectric filter having an improved attenuation characteristic in an attenuation band by making the attenuation characteristic less likely to be influenced by the TE mode even when the dielectric filter is used in the above-described high-frequency band.

A dielectric filter according to this invention is configured in a following manner.

(1) A dielectric filter includes: a substantially rectangular dielectric block; a plurality of parallel inner-conductor holes provided inside of the dielectric block, the plurality of inner-conductor holes penetrating through the dielectric block from a first surface (open circuit surface) of the dielectric block to a second surface (short circuit surface) opposite the first surface; inner conductors formed on inner surfaces of the inner-conductor holes; an outer conductor formed on second to sixth surfaces, which are outer surfaces of the dielectric block excluding the first surface; and input/output electrodes formed to extend from the third and fourth surfaces to the fifth surface, the input/output electrodes separated from the outer conductor by an outer-conductor-free part, the third and fourth surfaces which are lateral surfaces located at respective ends in an arrangement direction of the inner-conductor holes and near the inner-conductor holes, the fifth surface which is a mounting surface against a mounting board, wherein a side of each of the input/output electrodes against the first surface is substantially in parallel to the first surface and an intersection of a side against the second surface and a side against the sixth surface is tapered.

(2) An outer conductor is formed between the first surface of the dielectric block and the side of the input/output electrodes against the first surface of the dielectric block on the outer surface of the dielectric block.

(3) The outer conductor formed on the third and fourth surfaces has tapered parts against the respective tapered parts of the input/output electrodes at a predetermined gap.

(4) A gap between the input/output electrodes and the outer conductor on the fifth surface is set larger than a gap between the input/output electrodes and the outer conductor on the third and fourth surfaces.

According to this invention, following advantages are provided.

(1) Since the side of the input/output electrodes against the first surface (open circuit surface) of the dielectric block is formed substantially in parallel to the first surface, coupling volumes to a TEM mode to be originally coupled can be guaranteed. On the other hand, since the intersection of the side of the input/output electrodes against the second surface (short circuit surface) of the dielectric block and the side against the sixth surface (surface opposite to the mounting surface) is tapered, i.e., the input/output electrodes have a tapered shape, therefore coupling volumes to a TE mode can be effectively suppressed without reducing the coupling volumes to the TEM mode.

As described below, an area near the side of the input/output electrodes against the first surface mainly contributes to coupling volumes to the TEM mode. An area of the input/output electrodes near the center of the dielectric block (near the center of the height when the dielectric filter is mounted on a mounting board) mainly contributes to coupling to the TE mode.

Accordingly, the coupling volumes to the TE mode is suppressed and large attenuation can be guaranteed on higher and lower sides of a pass band of the originally utilized TEM mode.

(2) By forming the outer conductor between the first surface of the dielectric block and the side of the input/output electrodes against the first surface, an extended part of the open circuit surface resulting from the outer-conductor-free part located around the input/output electrodes is eliminated and an equivalent open area of the open circuit surface, which is the first surface of the dielectric block, is reduced. Accordingly, a resonant frequency of the TE mode is shifted to a higher band and an influence of the TE mode can be further suppressed.

(3) By proving tapered parts in the outer conductor against the tapered parts of the input/output electrodes, the size of a magnetic field loop of the TE mode to be trapped in the dielectric block can be reduced and a resonant frequency of the TE mode can be effectively made higher.

(4) Since stray capacitance between the input/output electrodes and the outer conductor can be efficiently reduced without changing the coupling volume to the TE mode by setting the gap between the input/output electrodes and the outer conductor on the fifth surface (mounting surface) of the dielectric block larger than the gap between the input/output electrodes and the outer conductor on the third and fourth surfaces of the dielectric block (lateral surfaces located at respective ends in an arrangement direction of the inner-conductor holes), the coupling volume between the input/output electrodes and the TEM mode can be increased. Accordingly, the size of the input/output electrodes on the third and fourth surfaces can be reduced by an equivalent extent and the coupling volumes to the TE mode can be relatively suppressed.

REFERENCE NUMERALS

Figure 1:
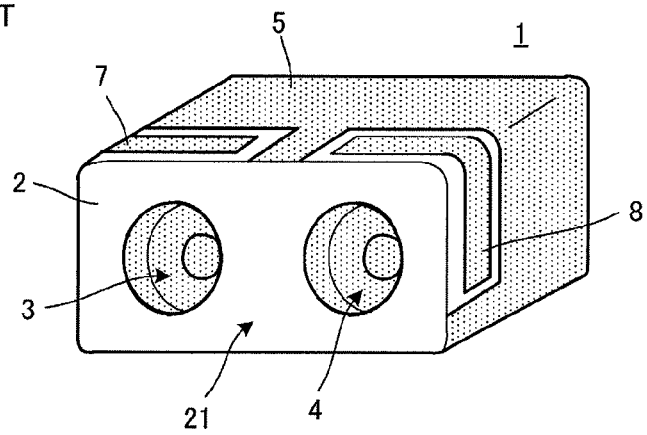
FIG. 1 PRIOR ART
FIG. 1 is an exterior perspective view of a dielectric filter disclosed in Patent Document 1.
Figure 2:
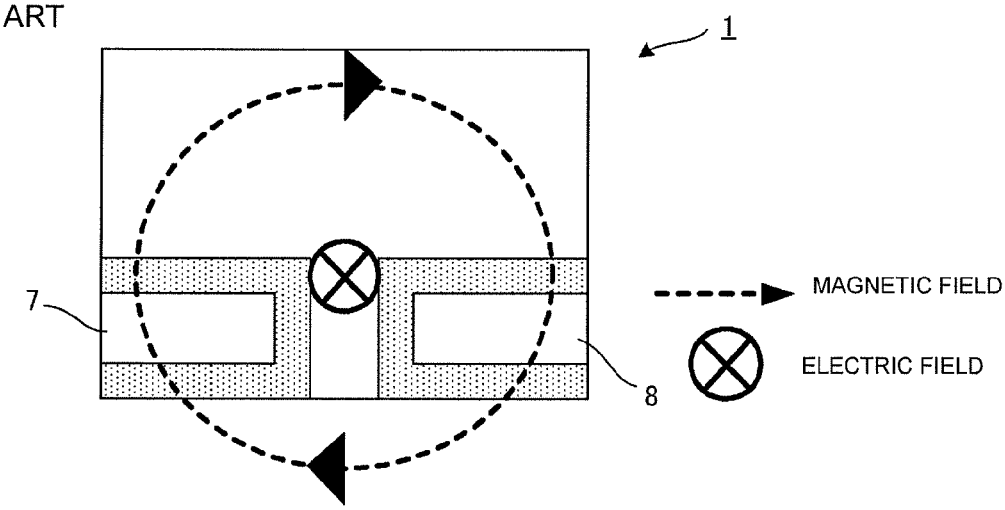
FIG. 2 PRIOR ART
FIG. 2 is a diagram showing a state of electric and magnetic fields in a TE101 mode generated in a dielectric filter including a dielectric block.
Figure 3:
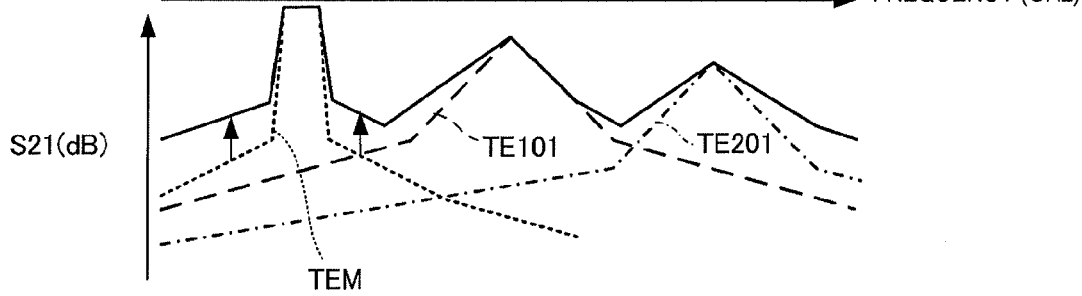
FIG. 3 PRIOR ART
FIG. 3 is a conceptual diagram of a transmission characteristic of three resonance modes generated in a dielectric filter.
Figure 4:
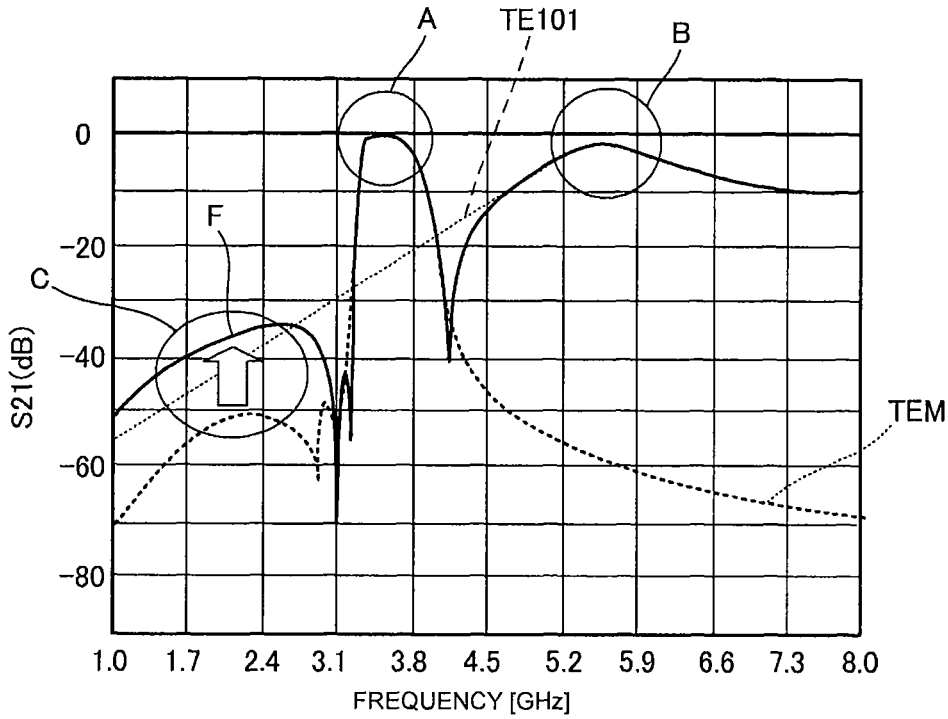
FIG. 4 PRIOR ART
FIG. 4 is a diagram showing an example of an actual transmission characteristic of a dielectric filter affected by a TE101 mode.

70 dielectric block
71 inner-conductor hole
72, 76-78 outer conductors
73, 75 input/output electrode
74 open-surface electrode
100, 101 dielectric filter
V1 side against a first surface
V2 side against a second surface
V6 side against a sixth surface
V26 tapered part

DETAILED DESCRIPTION OF THE INVENTION

First Embodiment

A dielectric filter according to a first embodiment will be described with reference to FIGS. 5, 6(A)-6(C), 7(A), 7(B) and 8.

Figure 5:
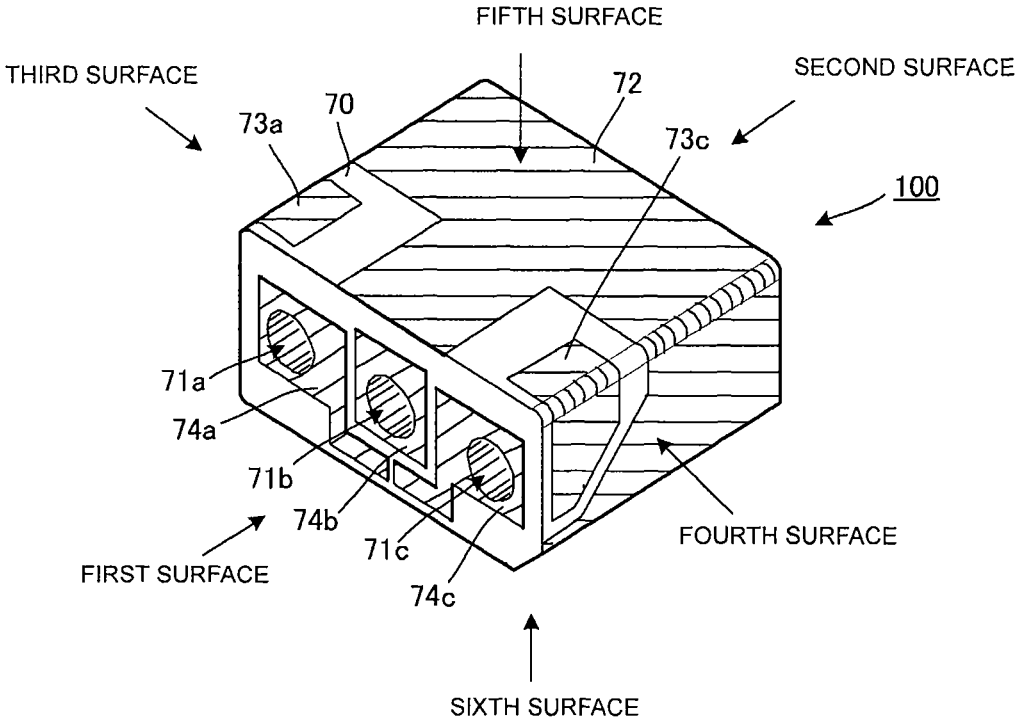
FIG. 5 is an exterior perspective view of a dielectric filter according to a first embodiment.

FIG. 5 is an exterior perspective view of the dielectric filter 100 according to the first embodiment. As shown in FIG. 5, a dielectric block 70 is substantially rectangular having first, second, third, fourth, fifth and sixth surfaces. The dielectric block 70 has parallel inner-conductor holes 71*a*, 71*b*, and 71*c* penetrating therethrough from the first surface to the second surface. Inner conductors are formed on inner surfaces of these inner-conductor holes 71*a*, 71*b*, and 71*c*. An outer conductor 72 (FIGS. 5, 6(A), 6(B) and 6(C)) is formed on five surfaces (second-sixth surfaces) of the dielectric block 70 excluding the first surface. Input/output electrodes 73*a* (FIG. 6(C)) and 73*c* (FIGS. 6(B) and 6(C)) are formed to extend from the third and fourth surfaces, which are lateral faces located at respective ends in an arrangement direction of the inner-conductor holes 71*a*-71*c* and located near the inner-conductor holes 71*a* and 71*c*, to the fifth surface, which is a mounting surface against a mounting board, respectively. These two input/output electrodes 73*a* and 73*c* are separated from the outer conductor 72 by a predetermined gap provided between the input/output electrodes and the outer conductor 72.

Open-circuit surface electrodes 74*a*, 74*b*, and 74*c* connected to one end of the respective inner conductors are formed on the first surface of the dielectric block 70. The other end of the respective inner conductors formed in the inner-conductor holes is connected (short-circuited) to the outer conductor 72 formed on the second surface of the dielectric block 70. That is, the first surface set as an open circuit surface and the second surface of the dielectric block 70 is set as a short circuit surface, respectively.

The inner conductors formed in the respective inner-conductor holes 71*a*-71*c*, the outer conductor 72 formed on the outer surface of the dielectric block 70, and the dielectric block 70 constitute three dielectric resonators that resonate in a TEM mode. Neighboring resonators are capacitively coupled by capacitance between the open-circuit surface electrodes 74*a*-74*b* and capacitance between the open-circuit surface electrodes 74*b*-74*c*. Furthermore, the first-stage resonator and the third-stage resonator are jump-coupled by capacitance between the open-circuit surface electrodes 74*a*-74*c*. In this manner, the dielectric filter 100 is constituted.

Figure 6C:
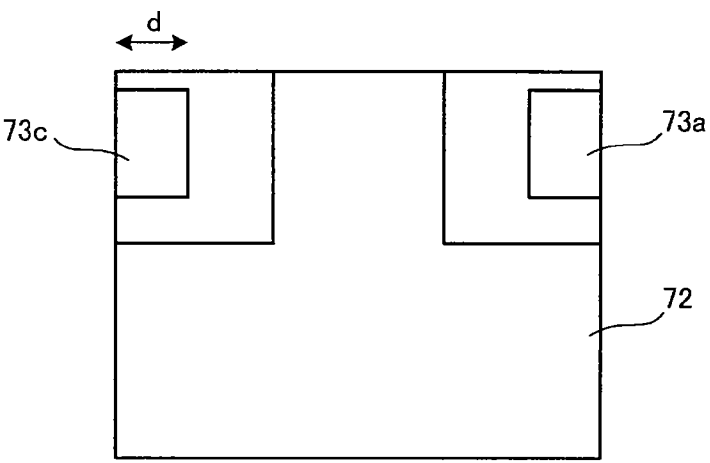
FIGS. 6(A) to 6(C) are three dimension drawings of the dielectric filter.
Figure 6B:
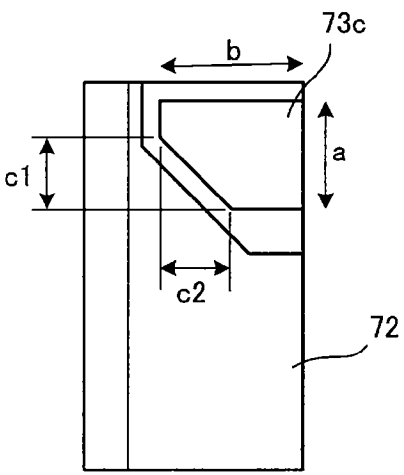
Figure 6A:
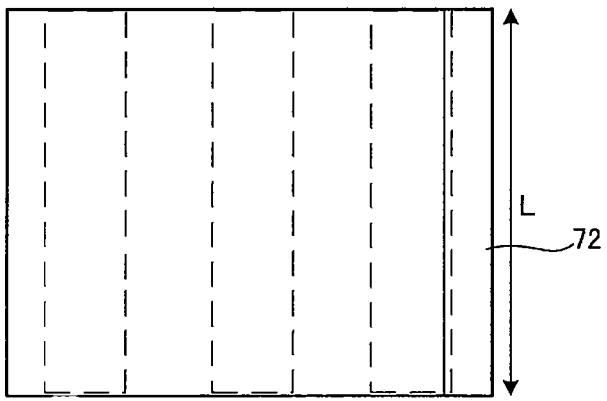

FIGS. 6(A), 6(B) and 6(C) are drawings of the dielectric filter according to the first embodiment. FIG. 6(A) is shown as the sixth surface, FIG. 6(B) is shown as the fourth surface, and FIG. 6(C) is shown as the fifth surface of the dielectric block, respectively.

The size of each part shown in FIGS. 6(A), 6(B) and 6(C) is as follows.

a: 1.2 mm, b: 1.5 mm, c1: 0.8 mm, c2: 0.8 mm (all in FIG. 6(B))

d: 1.0 mm (FIG. 6(C)), L: 4.0 mm (FIG. 6A))

Figure 7A:
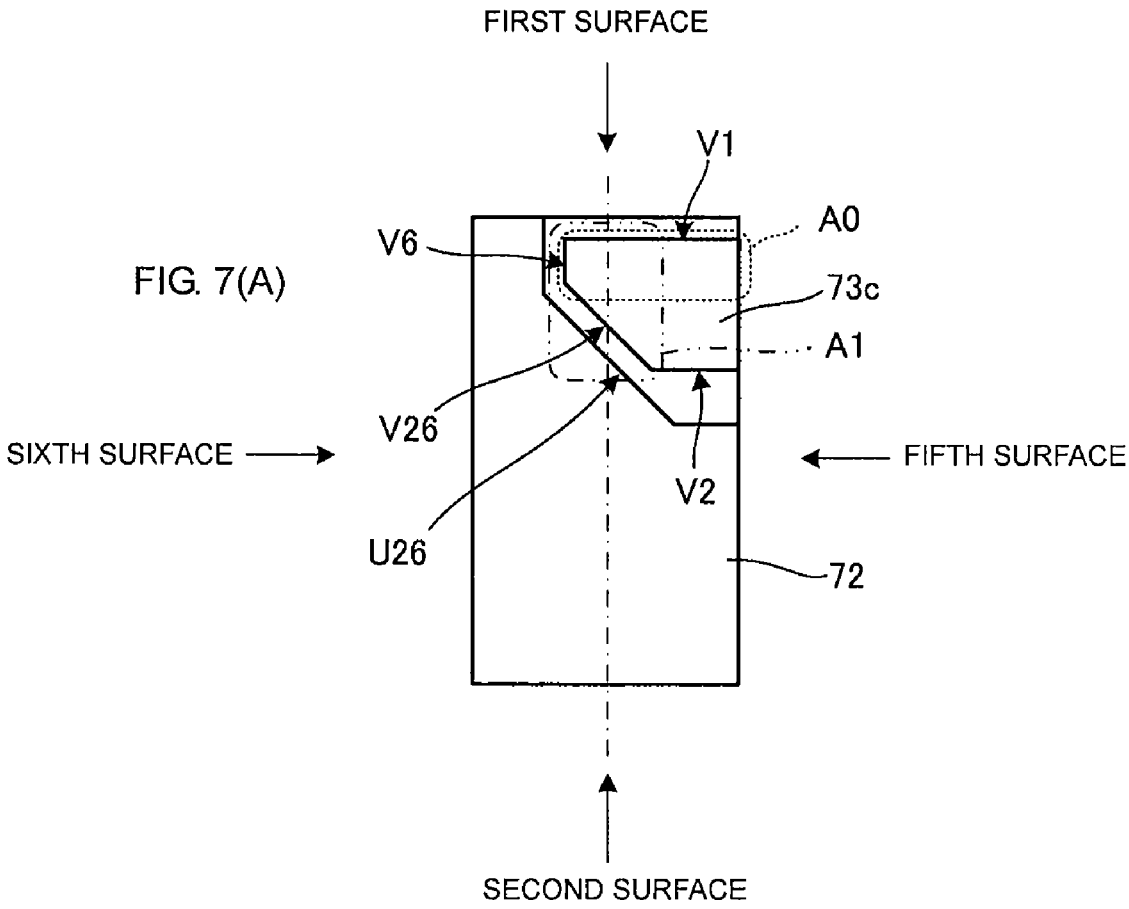
FIG. 7(A) is a lateral view of the dielectric filter and FIG. 7(B) is a lateral view of a comparison-target dielectric filter having an existing structure.
Figure 7B:
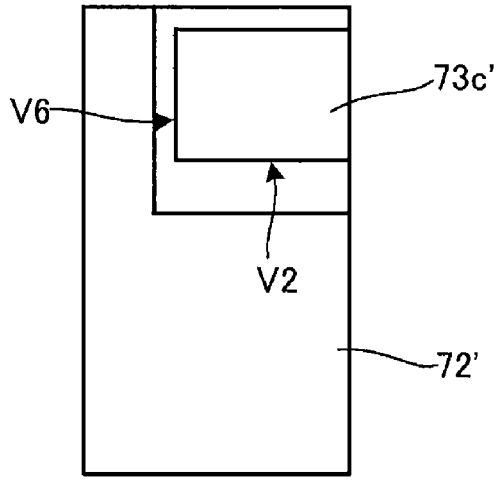
FIG. 7(B) PRIOR ART

FIGS. 7(A) and 7(B) are lateral views showing a difference between a shape of an area near the input/output electrode of the dielectric filter according to the first embodiment (FIG. 7(A)) and that of a known dielectric filter (FIG. 7(B)). As shown in FIG. 7(A), in the dielectric filter according to the first embodiment, the input/output electrode 73*c* is formed so that a side V1 against the first surface of the dielectric block is parallel to the first surface and a tapered part V26 is formed at an intersection of a side V2 against the second surface and a side V6 against the sixth surface.

Along with this, a tapered part U26 against the tapered part V26 of the input/output electrode 73*c* at a predetermined gap is also formed in the outer conductor 72.

Regarding the other input/output electrode 73*a*, the tapered part having a shape mirror-symmetrical to that of the input/output electrode 73*c* is formed.

Part of input/output electrodes 73*a* (FIG. 5) and 73*c*, which occupy a predetermined range, particularly closer to the first surface (open circuit surface) contributes coupling to a TEM mode. Accordingly, it can be said that an area (A0) shown in FIG. 7(A) contributes to the coupling to the TEM mode. On the other hand, it can be estimated that a part near the center of the height of the dielectric block (area indicated by a chain line in the drawing) particularly contributes to coupling to a TE mode based on various trial manufacturing and experiments. Accordingly, it can be said that an area (A1) shown in FIG. 7(A) contributes to the coupling to the TE mode.

By forming the tapered part V26 at the input/output electrode 73*c*, coupling volumes to the TE mode can be suppressed without reducing coupling volumes to the TEM mode.

The coupling volumes to the TE mode decreases if the size of the input/output electrode 73*c* is reduced by decreasing the length of the side V2 against the second surface of the dielectric block by a predetermined amount in FIG. 7(B) showing an existing structure as a comparative example, wherein 73*c*' is the input/output electrode, 72' is the outer conductor, V2 is the side of the input/output electrode 73*c*'against the second surface, and V6 is the side of the input/output electrode 73*c*' against the sixth surface. However, the coupling volumes to the TEM mode also decrease at the same time. Thus, an influence of the TE mode cannot be suppressed efficiently.

Figure 8:
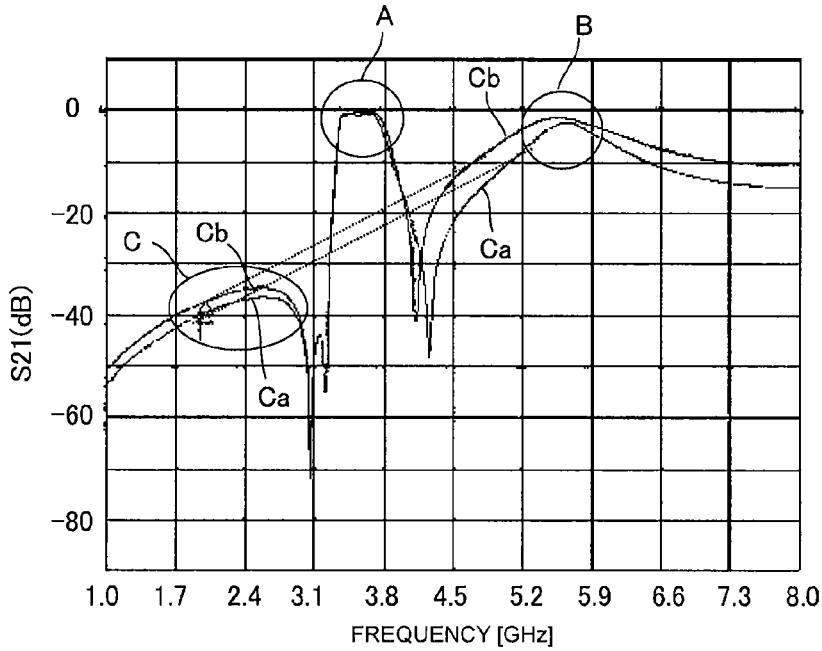
FIG. 8 is a diagram showing an improvement in a transmission characteristic of the dielectric filter.

FIG. 8 is a diagram showing transmission characteristics (S21) in dB of the two dielectric filters shown in FIGS. 7(A) and 7(B). Here, curves Ca and Cb represent a characteristic of the dielectric filter according to the first embodiment and a characteristic of the dielectric filter having an existing structure shown in FIG. 7(B), respectively. Since a response B resulting from the TE101 mode appears on a higher side of a pass band A, attenuation worsens. A rise in a transmission amount due to the TE mode is caused on a lower side as shown by "C". The use the input/output electrodes having the shape shown in FIG. 7(A) reduces the coupling volumes to the TE101 mode and the attenuation on the higher and lower sides of the pass band can be improved. In addition, since a magnetic field loop of the TE101 mode is reduced by providing the tapered part U26 (FIG. 7(A)) in the outer conductor, a resonant frequency of the generated TE101 mode is slightly shifted to a higher band. Accordingly, an influence of the TE101 mode can be further suppressed by an extent equivalent to the shift.

Meanwhile, in FIG. 5, gaps between the input/output electrodes 73*a* and 73*c* and the outer conductor 72 on the fifth surface of the dielectric block 70 are set larger than gaps between the input/output electrodes 73*a* and 73*c* and the outer conductor 72 on the third and fourth surfaces, respectively. With such a configuration, since stray capacitance between the input/output electrodes 73*a* and 73*c* and the outer conductor 72 is reduced, the coupling volumes between the input/output electrodes 73*a* and 73*c* and the TEM mode can be increased without changing the coupling volumes to the TE mode. Accordingly, the size of the input/output electrodes 73*a* and 73*c* on the third and fourth surface can be reduced by that extent and the coupling volumes to the TE mode can be relatively suppressed.

Second Embodiment

Figure 9A:
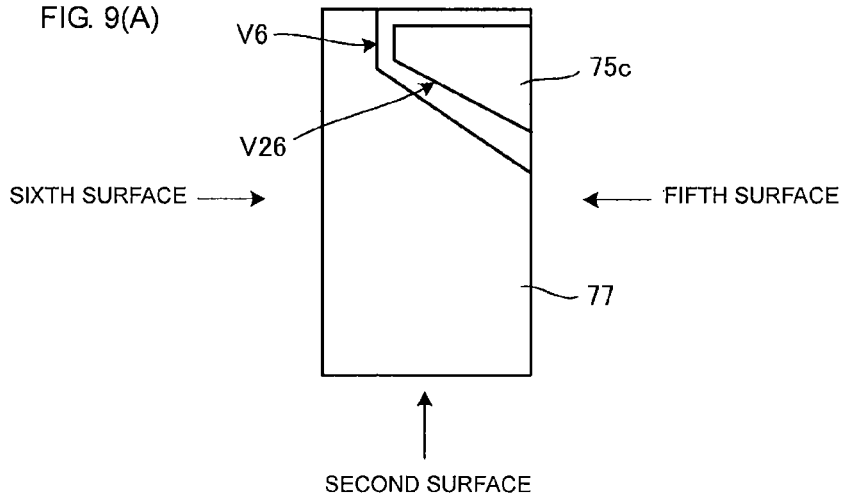
FIGS. 9(A) and 9(B) are lateral views of a dielectric filter according to a second embodiment.
Figure 9B:
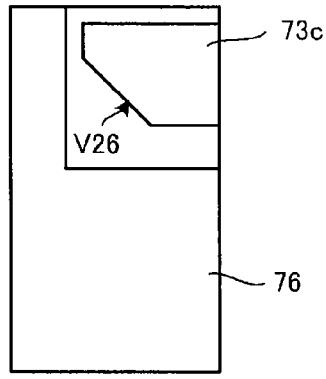

FIGS. 9(A) and 9(B) are lateral views of a dielectric filter according to a second embodiment.

In an example of FIG. 9(A), a range of a tapered part V26 of an input/output electrode 75*c* is extended to reach a fifth surface and a side against a second surface is substantially eliminated, and the side V6 against the sixth surface remains. Along with this, a tapered part of an outer conductor 77 is also extended. With such a shape, coupling to a TE mode can be effectively suppressed without decreasing coupling volumes to a TEM mode much.

In an example of FIG. 9(B), an area of an outer conductor 76 where an input/output electrode 73*c* is formed is cut in a rectangular shape. In this manner, a part against the tapered part V26 of the input/output electrode 73*c* may be formed as an outer-conductor-free part.

However, since the fifth surface of the dielectric block serves as a mounting surface, it is more convenient to form the input/output electrodes having the side V2 as shown in FIG. 7(A) than a case of FIG. 9(A) with respect to mounting convenience and post-mounting reliability. More specifically, if the side V2 facing in parallel to the second surface is present when the dielectric filter is mounted on a mounting board, solder fillet preferably rises. Thus, a substantial contact area can be increased and the reliability increases with respect to stress concentration. In addition, since the open area of the outer conductor is reduced in the configuration of FIG. 7(A) compared with that of FIG. 9(B), the size of the magnetic field loop of the TE mode is reduced. Accordingly, a resonant frequency of the TE mode can be made higher by that extent and an influence of the TE mode can be further suppressed.

Third Embodiment

Figure 10B:
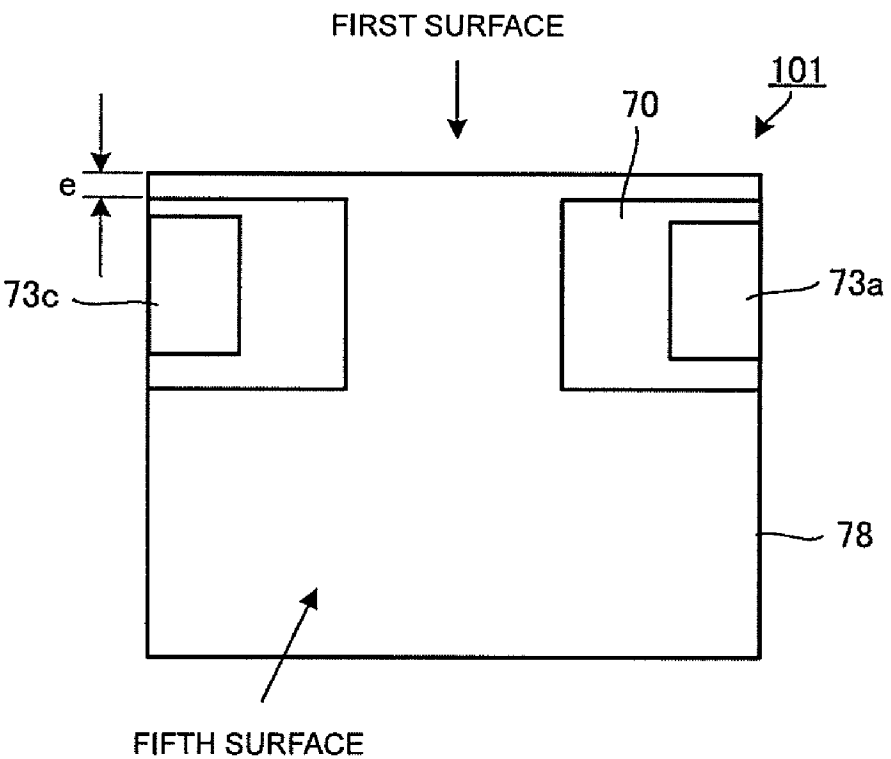
FIGS. 10(A) and 10(B) are two dimensional drawings of a dielectric filter according to a third embodiment.
Figure 10A:
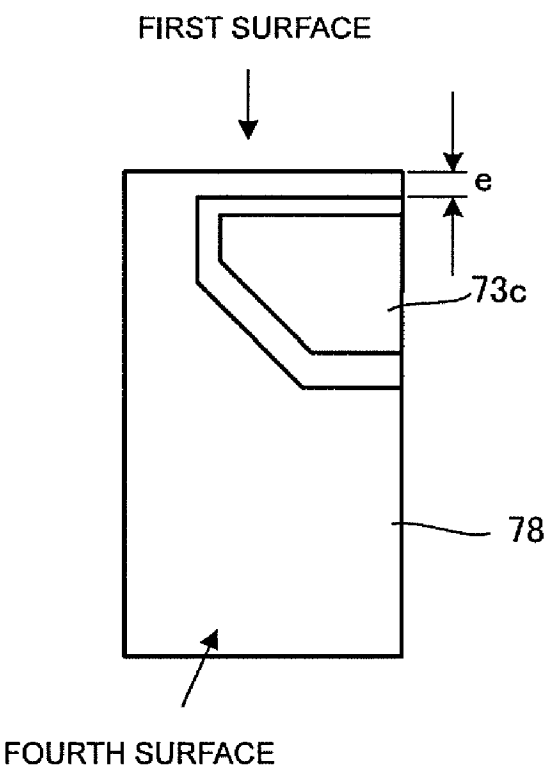

FIGS. 10(A) and 10(B) are two dimension drawings of a dielectric filter according to a third embodiment. More specifically, FIG. 10(A) is a lateral view of a dielectric filter 101 showing a fourth surface of a dielectric block, whereas FIG. 10(B) is a plan view of the dielectric filter 101 showing a fifth surface of the dielectric block 70. Different from a configuration shown in FIGS. 6(A) and 6(B) in the first embodiment, an outer conductor 78 is formed also at an area, represented by "e", between a first surface and a side of input/output electrodes 73*a* and 73*c* against the first surface.

With such a configuration, an extended part of an open circuit surface resulting from an outer-conductor-free part located near the input/output electrodes is eliminated and an equivalent open area of the open circuit surface, which is the first surface of the dielectric block, is reduced. Accordingly, the size of the magnetic field loop of the TE mode is reduced, a resonant frequency of the TE mode is shifted to a higher band, and an influence of the TE mode can be further suppressed.

Figure 11:
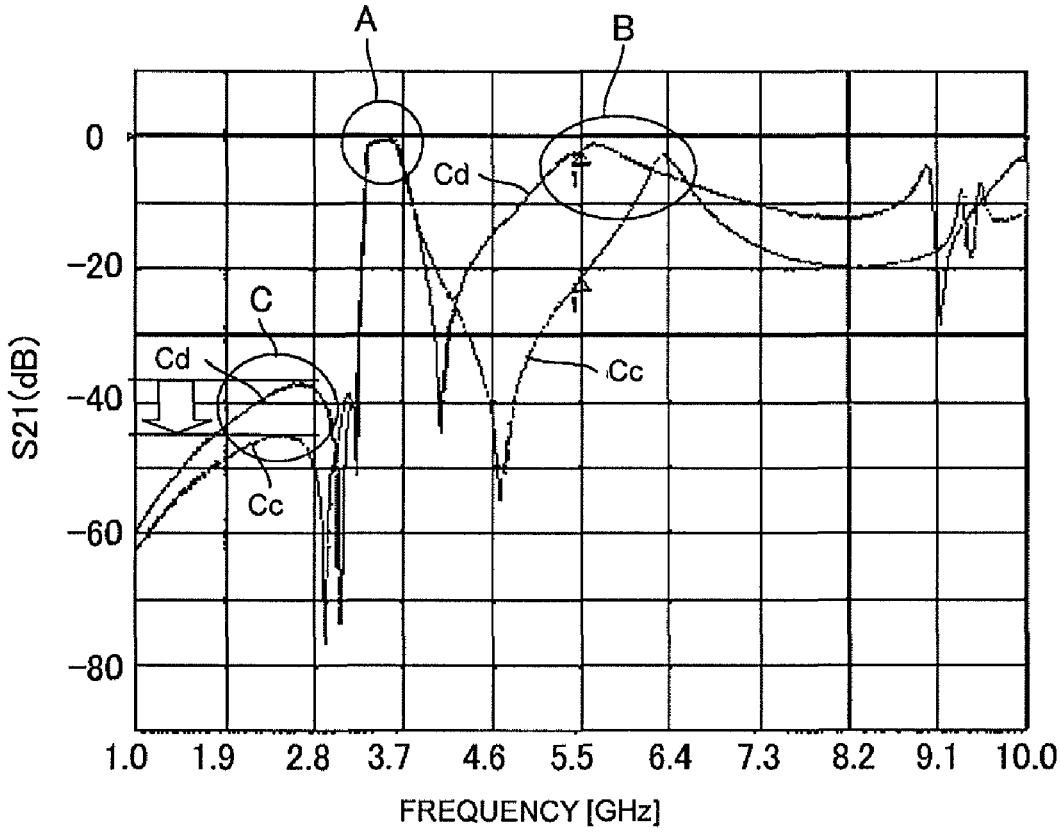
FIG. 11 is a diagram showing a transmission characteristic of the inventive dielectric filter.

FIG. 11 is a diagram showing transmission characteristics (S21) in dB of the dielectric filter shown in FIGS. 10(A) and 10(B) and the comparison-target dielectric filter shown in FIG. 7(A) according to the first embodiment. Here, a curve Cc represents a characteristic of the dielectric filter according to the third embodiment, whereas a curve Cd represents a characteristic of the dielectric filter having the structure shown in FIG. 7(A). Since a response B resulting from the TE101 mode appears on a higher side of a pass band A, attenuation worsens. A rise in a transmission amount due to the TE mode is caused on a lower side as shown by "C". The effect of the outer conductor 78 formed near the first surface (open circuit surface) shown in FIGS. 10(A) and 10(B) effectively reduces the size of the magnetic field loop of the TE101 mode and a resonant frequency of the TE101 mode is greatly shifted to a higher band. Accordingly, the influence of the TE101 mode can be further suppressed. In particular, attenuation on the lower band side can be further improved by approximately 20 dB as shown by "C".

The dielectric filter in which the open-circuit surface electrodes for inter-resonator coupling are formed on the first surface (open circuit surface) of the dielectric block has been illustrated in each of the above-described embodiments. However, the present invention can be similarly applied to dielectric filters in which resonators are coupled by the shape of inner conductors, e.g., a step structure, instead of proving the open-circuit surface electrodes on the first surface.

In addition, the number of the inner-conductor holes is not limited to three and the present invention can be similarly applied to dielectric filters having two inner-conductor holes and four or more inner-conductor holes.

The invention claimed is:

1. A dielectric filter comprising:

a dielectric block having first and second opposed surfaces, third and fourth opposed surfaces, and fifth and sixth opposed surfaces;

a plurality of inner-conductor holes provided inside of the dielectric block and extending between the first surface and the second surface of the dielectric block;

an outer conductor on at least a portion of each of the second to sixth surfaces of the dielectric block; and at least two input/output electrodes, a first of the at least two input/output electrodes extending from the third surface to the fifth surface, a second of the at least two input/output electrodes extending from the fourth surface to the fifth surface, each of the at least two input/output electrodes being separated from the outer conductor by an outer-conductor-free part, wherein a first side of at least one of the first and second input/output electrodes proximal to the first surface is substantially in parallel to the first surface and a second side of the at least one of the first and second input/output electrodes is tapered relative to the second and sixth surfaces, the first and second sides being located on one of the third and fourth opposed surfaces, and wherein the first side and the second side of the at least one of the first and second input/output electrodes are dimensioned and positioned such that a first coupling volume to a TE mode is lower than a second coupling volume to a TEM mode.

2. The dielectric filter according to claim 1, wherein the outer conductor extends between the first surface of the dielectric block and the first side of the input/output electrode on at least the one of the third and fourth opposed surfaces.

3. The dielectric filter according to claim 1, wherein the outer conductor has a tapered part facing the second side of the at least one of the first and second input/output electrodes at a predetermined gap therebetween.

4. The dielectric filter according to claim 3, wherein the tapered second side extends to the fifth surface.

5. The dielectric filter according to claim 4, wherein the tapered part of the outer conductor extends to the fifth surface.

6. The dielectric filter according to claim 1, wherein the tapered second side extends to the fifth surface.

7. The dielectric filter according to claim 1, wherein a first gap between the at least one of the first and second input/output electrode and the outer conductor on the fifth surface is larger than a second gap between the at least one of the first and second input/output electrode and the outer conductor on the third or fourth surface.

8. The dielectric filter according to claim 1, wherein the first and second input/output electrodes are symmetrical with respect to an imaginary center line crossing the dielectric filter.

9. The dielectric filter according to claim 1, wherein a portion of the outer conductor surrounding the at least one of the first and second input/output electrodes is rectangular in shape.

* * * * *